United States Patent [19]

Mittleman et al.

[11] 4,133,441

[45] Jan. 9, 1979

[54] INJECTION SITE

[75] Inventors: Herbert Mittleman, Deerfield; Michael O. Pekkarinen, Lincolnshire, both of Ill.

[73] Assignee: Baxter Travenol Laboratories, Inc., Deerfield, Ill.

[21] Appl. No.: 889,207

[22] Filed: Mar. 23, 1978

[51] Int. Cl.[2] ..... B65D 47/36

[52] U.S. Cl. ..... 215/247; 215/320

[58] Field of Search ..... 215/247, 248, 249, 317, 215/320, 321, DIG. 3

[56] References Cited

U.S. PATENT DOCUMENTS

| | | | |
|---|---|---|---|
| 711,430 | 10/1902 | Leuthesser | 215/320 |
| 1,616,274 | 2/1927 | Mulford | 215/247 |
| 2,202,163 | 5/1940 | Mulford | 215/DIG. 3 |
| 2,486,364 | 10/1949 | Simmons | 215/321 X |
| 3,343,699 | 9/1967 | Nicko | 215/247 |
| 3,459,320 | 8/1969 | Itoh | 215/320 X |

*Primary Examiner*—Donald F. Norton

*Attorney, Agent, or Firm*—Paul C. Flattery; John P. Kirby, Jr.; George H. Gerstman

[57] ABSTRACT

An injection site is provided which is molded inside out with inwardly extending rings. The rings have a smaller internal diameter than the external diameter of the tubular member to which the injection site is to be connected. The injection site has a central portion for receiving a needle therethrough, and a first, cylindrical portion which is extended into the tubular member. After such insertion, the portion with the attached rings is folded back onto the tubular member. The rings become positioned on the outside of the assembly and are in the compressed state squeezing tightly against the tubular member.

2 Claims, 6 Drawing Figures

INJECTION SITE

BACKGROUND OF THE INVENTION

This invention relates to an improved injection site.

It is an object of the present invention to provide a unitary, molded injection site formed of self-sealing, pierceable, resilient material.

Another object of the present invention is to provide an injection site which is simple in construction and permits mass and economical manufacture and assembly.

A further object of the present invention is to provide an injection site which may be used with, but is not limited to use with, an "H" tube attached to a parenteral fluid container.

Another object of the present invention is to provide an injection site having a construction enabling the injection site to be pressure fitted with respect to a tubular member and to be retained snugly with respect to the tubular member once it is attached thereto.

A further object of the present invention is to provide an injection site having improved needle-piercing and removing qualities.

Another object of the invention is to provide an injection site that is constructed so as to enable effective resealing, and thus prevent leakage after the needle is withdrawn.

A still further object of the invention is to provide an injection site which tends to squeeze the tube to which it is connected tighter while the needle is being withdrawn.

Further objects and advantages of the present invention will become apparent as the description proceeds.

SUMMARY OF THE INVENTION

In accordance with the present invention, a unitary, molded injection site is formed of self-sealing, pierceable, resilient material, and comprises a central portion, a first, generally cylindrical portion and a second generally cylindrical portion.

The central portion is adapted for receiving a needle therethrough. The first, generally cylindrical portion is contiguous with the central portion and extends in a first direction therefrom. The first portion defines a central bore which terminates at one end of the central portion and is open at the other end.

The second, generally cylindrical portion is contiguous with the central portion and extends in a second direction opposite to the first direction. The second portion defines an axial opening which is of a sufficient size to enable the second portion to be folded over the first portion. The walls of the second portion defining the axial opening include a plurality of spaced, inwardly extending rings.

The first portion is adapted for insertion in a tubular member with the second portion being folded back onto the tubular member. In this manner, the rings will extend outwardly and be in a compressed state, thereby retaining the injection site in place and positioning the central portion transverse the opening of the tubular member. In the illustrative embodiment, the rings have an internal diameter that is smaller than the external diameter of the tubular member to which the injection site is to be connected.

A more detailed explanation of the invention is provided in the following description and claims, and is illustrated in the accompanying drawings.

DETAILED DESCRIPTION OF THE ILLUSTRATIVE EMBODIMENT

Figure 1:
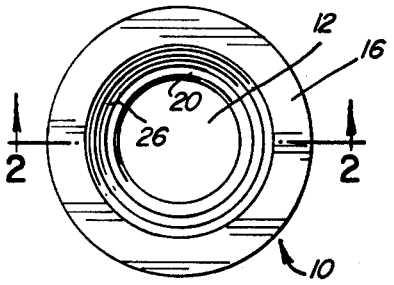
FIG. 1 is a top view of an injection site constructed in accordance with the principles of the present invention.
Figure 2:
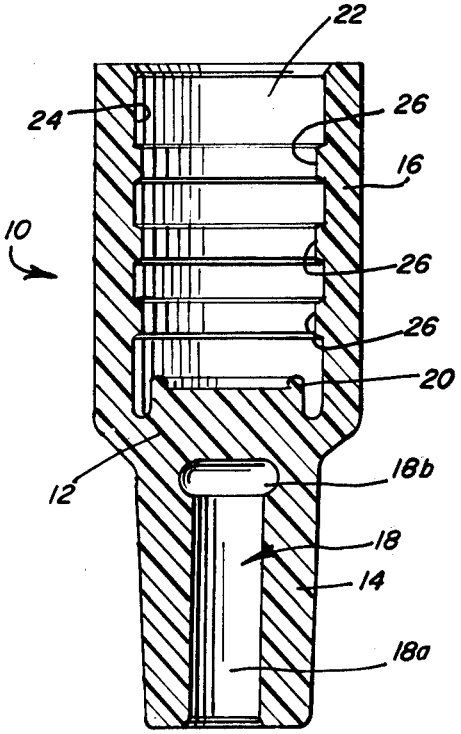
FIG. 2 is a cross-sectional view thereof, taken along the plane of the line 2—2 of FIG. 1.

First referring to FIGS. 1 and 2, the injection site 10 is shown prior to its attachment to a tubular member. Injection site 10 is preferably formed as a unitary, one-piece, molded device and is formed of a self-sealing, piercable, resilient material, as is well-known in the injection site art, for example rubber.

The injection site 10 comprises a central portion 12 which receives a needle therethrough, a first cylindrical portion 14 and a second cylindrical portion 16. First portion 14 is contiguous with central portion 12, extends downwardly therefrom, and defines a central bore 18. Central bore 18 is axially symmetrical and includes (1) a main portion **18*a* which is open at the distal end of first portion 14, and (2) an undercut portion 18*b*. Undercut portion 18*b* comprises a volume having a greater diameter than the diameter of portion 18*a*, with undercut portion 18*b* terminating at central portion 12**.

Central portion 12 includes an upstanding ring 20 which aids the action of the injection site with respect to a needle injected thereto and removed therefrom.

Second cylindrical portion 16 is contiguous with central portion 12 and extends upwardly as illustrated in FIG. 2. Second portion 16 defines an axial opening 22 which is of a sufficient size to enable the second portion 16 to be folded over as described below and as illustrated in FIGS. 3–6.

The internal wall 24 of second portion 16 includes a number of axially spaced, inwardly extending rings 26. Each of rings 26 has an internal diameter that is smaller than the external diameter of the tubular member to which the injection site is to be connected. In this manner, when the second portion 16 is folded back over the tubular member, the rings which then become positioned on the outside are in the compression state squeezing tightly against the tubular member.

Figure 3:
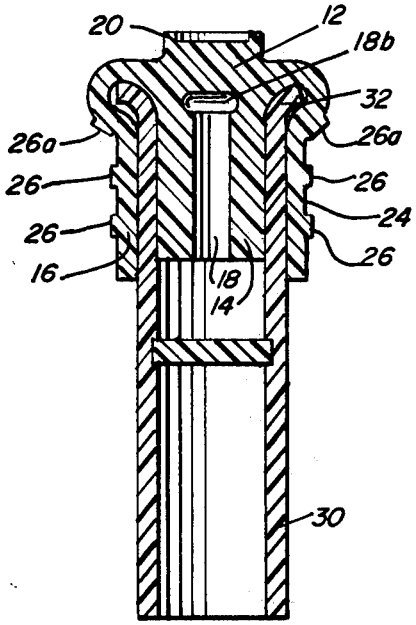
FIG. 3 is a cross-sectional view of an injection site in place on a tubular member.

The connection of injection site 10 to a tubular member 30 is illustrated in FIG. 3. Tubular member 30 comprises an "H" tube having an outwardly flared outer end 32. It is to be understood, however, than an injection site constructed in accordance with the principles of the present invention could be attached to other tubular members, such as bottle necks, ports, etc.

It can be seen referring to FIG. 3 that first portion 14 has been inserted into the opening of H-tube 30, so that central portion 12 is positioned transverse the opening of H-tube 30. Central portion 12 is located above the bottom of outwardly flared end 32. Second portion 16 has been folded back over the end of tube 30, and with the rings being on the outside and having a smaller internal diameter than the external diameter of tube 30, the rings are in a compression state urging second portion 16 tightly against the outside of tube 30.

It is preferred that at least one of the rings 26 be at an angle exerting its force at a right angle to the flare of the tube. To this end, ring 26*a* is positioned to exert its force at a right angle to flared end 32. Ring 26*a* has been found to aid significantly in squeezing the injection site in place against the tube.

As a result of the rings 26 being in a compression state about the tube 30, when the assembly is sterilized, tube 30 becomes somewhat softened. While in the softened condition, the compressing rings 26 tend to deform the outside surface of the tube slightly, forming undulations. In this manner, the injection site is retained very snugly with respect to the tube 30.

Figure 4:
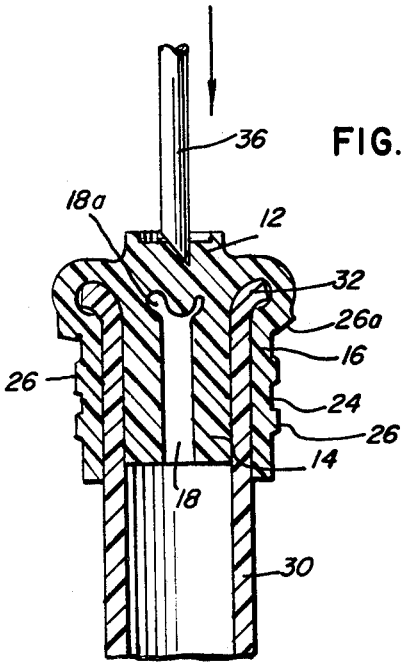
FIG. 4 is a cross-sectional view of an injection site being pierced by a needle, with the needle breaking the surface of the central portion.
Figure 6:
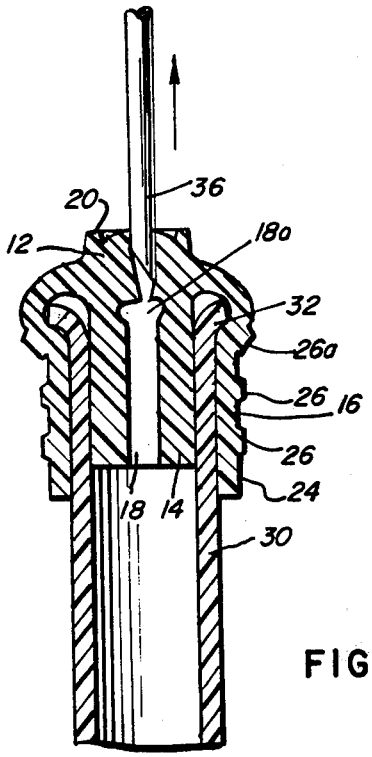
FIG. 6 is a view similar to FIGS. 4 and 5, but with the needle being withdrawn from the central portion.
Figure 5:
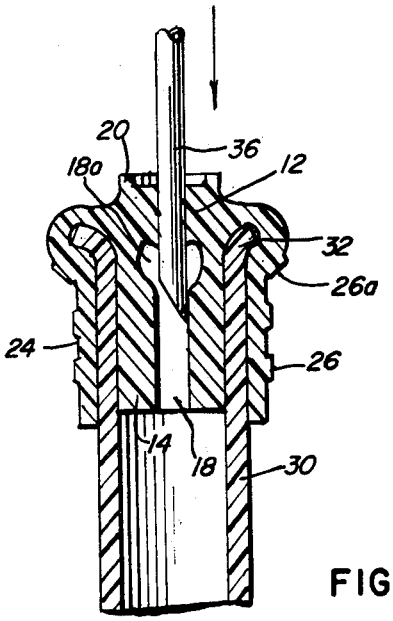
FIG. 5 is a view similar to FIG. 4, but with the needle having broken through the central portion.

The undercut portion 18*b* allows a needle to penetrate more easily. Further, undercut portion 18*b*, combined with the action of the second portion 16 against tube 30, operates in a manner to enhance the resealing ability of injection site. Thus, when needle 36 is injected into central portion 12, and the central portion becomes deformed, after the needle is withdrawn the original deformation will not be detrimental to sealing, but instead retraction of the material will provide an effective seal resistant to leakage. The action of the injection site during initial piercing, continued inward movement and needle retraction is illustrated in FIGS. 4- 6 which respectively show forward stretch, needle drag and resealing capability.

It has also been found that the above structural combination of second portion 16, central portion 12 located above the bottom of flared end 32, combined with undercut 18*b*, operates to provide a "Chinese finger" effect when the needle is withdrawn. In other words, when the needle is withdrawn, as illustrated in FIG. 6, the tube 32 effectively squeezes against first portion 14 to retain first portion 14 within the tube 32.

Although no limitations are intended, in a specific example an injection site has been found to be satisfactory having an overall extended length (as illustrated in FIG. 1) of 0.675 inch, with the external diameter of first portion 14 varying from 0.171 inch at its distal end to 0.188 inch adjacent central portion 12. The outer diameter of second portion 16 was 0.27 inch, the internal diameter of walls 24 was 0.195 inch and the internal diameter of rings 26 was 0.175 inch.

Although an illustrative embodiment of the invention has been shown and described, it is to be understood that various modifications and substitutions may be made without departing from the novel spirit and scope of the present invention.

What is claimed is:

1. A unitary, molded injection site formed of self-sealing, pierceable, resilient material, which comprises:

a central portion for receiving a needle therethrough;

a first generally cylindrical portion contiguous with said central portion and extending in a first direction therefrom, said first portion defining a central bore which terminates at one end at said central portion and is open at the other end;

said central bore defined by said first portion comprising an elongated axial bore with a portion of the bore adjacent said central portion forming an undercut to enable said central portion, when pierced by a needle, to have greater stretching potential than if the undercut were not present, said undercut comprising an open volume adjacent said central portion, which open volume has a greater diameter than the diameter of the central bore other than said open volume;

a second generally cylindrical portion contiguous with said central portion and extending in a second direction opposite said first direction, said second portion defining an axial opening which is of a sufficient size to enable said second portion to be folded over said first portion, the walls of said second portion defining said axial opening including a plurality of spaced, inwardly extending rings;

said rings having an internal diameter that is smaller than the external diameter of the tubular member to which the injection site is to be connected;

said first portion being adapted for insertion in a tubular member with said second portion being folded back onto the tubular member whereby said rings will extend outwardly and be in a compressed state thereby retaining the injection site in place and positioning said central portion transverse the opening of the tubular member.

2. In a tubular member having an outwardly flared end portion, a unitary, molded injection site pressure fitted into the end of the tubular member, comprising:

a central portion for receiving a needle therethrough, said central portion being located above the bottom of the outwardly flared end portion;

a first, generally cylindrical portion contiguous with said central portion and extending into said tubular member, said first portion defining a central bore which terminates at one end at said central portion and is open at the other end;

said central bore defined by said first portion comprising an elongated axial bore with a portion of the bore adjacent said central portion forming an undercut to enable said central portion, when pierced by a needle, to have greater stretching potential than if the undercut were not present, said undercut comprising an open volume adjacent said central portion, which open volume has a greater diameter than the diameter of the central bore other than said open volume;

a second, generally cylindrical portion contiguous with said central portion and being folded over the end portion of said tubular member, said second portion carrying a plurality of rings which are in a compressed state when said second portion is folded over the end portion of the tubular member, to thereby retain the injection site in place with respect to said tubular member with said central portion positioned transverse the opening of the tubular member, at least one of the rings is at an angle exerting a force transverse the flared end portion of the tubular member.

* * * * *